United States Patent [19]

Hunter

[11] 4,050,545

[45] Sept. 27, 1977

[54] VEHICLE LIFTING JACK ASSEMBLY

[76] Inventor: Lee Hunter, 13501 Ladue Road, Ladue, Mo. 63141

[21] Appl. No.: 684,495

[22] Filed: May 10, 1976

[51] Int. Cl.[2] ..... B66F 7/00

[52] U.S. Cl. ..... 187/8.43; 187/8.5

[58] Field of Search ..... 187/8.41, 8.43, 8.47, 187/8.49, 8.5, 8.54; 254/93 L, 89 H

[56] References Cited

U.S. PATENT DOCUMENTS

| | | | |
|---|---|---|---|
| 1,993,060 | 3/1935 | Hott | 187/8.43 |
| 2,080,481 | 5/1937 | Hott | 187/8.43 |
| 2,250,321 | 7/1941 | Aron | 187/8.43 |
| 2,849,084 | 8/1958 | Hott et al. | 187/8.5 |
| 3,563,345 | 2/1971 | MacMillan et al. | 187/8.43 |
| 3,789,958 | 2/1974 | Masaitis | 187/8.49 |
| 3,831,713 | 8/1974 | Clarke | 187/8.54 X |

FOREIGN PATENT DOCUMENTS

| | | | |
|---|---|---|---|
| 1,312,475 | 11/1962 | France | 187/8.47 |

*Primary Examiner*—Evon C. Blunk
*Assistant Examiner*—James L. Rowland
*Attorney, Agent, or Firm*—Gravely, Lieder & Woodruff

[57] ABSTRACT

A vehicle lifting jack assembly comprising a swing type jack mounted on a vehicle lift rack in position to swing from a folded position to allow complete lowering of the rack to an operative vehicle lift position, and safety means which locks the jack in the lift position to prevent folding and provides positive retention of the jack in any of its vehicle lift positions.

6 Claims, 6 Drawing Figures

VEHICLE LIFTING JACK ASSEMBLY

BRIEF SUMMARY OF THE INVENTION

Equipment for servicing vehicles many times includes hoists or lift racks which elevate the vehicle to positions in which service operations and procedures may be performed easily and quickly. The vehicle normally stands on its wheels on the rack runways, and in certain wheel alignment adjustment procedures, the vehicle wheels must be elevated or jacked up off the rack runways.

The jacking of the vehicle may be accomplished by either individual fluid pressure jacks which are set under the vehicle and supported on some part of the hoist or rack, or by hand operated screw jack stands. The fluid pressure jacks are to be preferred as the pressure lines can be connected for obtaining lift simultaneously at both wheels. The usual safeguards for fluid pressure jacks resides in the valving such as check valves which require manual operation to release the fluid when the vehicle is to be lowered.

The present invention is directed to a vehicle lifting jack assembly and to vehicle jack safety means. More particularly the invention is directed to safety means for the type of jacks which are pivotally mounted on the vehicle hoist or rack in position to be moved from a folded inoperative position to an operative vehicle lift position.

The vehicle jack assembly comprises a mounting beam carried by the rack or hoist for pivoting movement, a pair of fluid pressure cylinders supported by the beam on a base plate connected to the beam, and a vehicle lift bar connected to the rams in the cylinders. The fluid pressure cylinders depend from the mounting beam so that the lift bar can be lowered to the beam for permitting the assembly to be positioned under the vehicle, and the cylinders are spaced so as to provide lateral stability in the vehicle raised position.

The objects of this invention are to provide the vehicle jack assembly with positive safety means which will lock the jack assembly against pivoting into its folded position while lifting a vehicle, to provide means to positively retain the lift bar in its vehicle lift positions, and to provide means to guard against the accidental release of the assembly from its lift position.

BRIEF DESCRIPTION OF THE DRAWINGS

The presently preferred embodiment of this invention is shown in the accompanying drawings, wherein.

DETAILED DESCRIPTION OF THE EMBODIMENT

Figure 1:
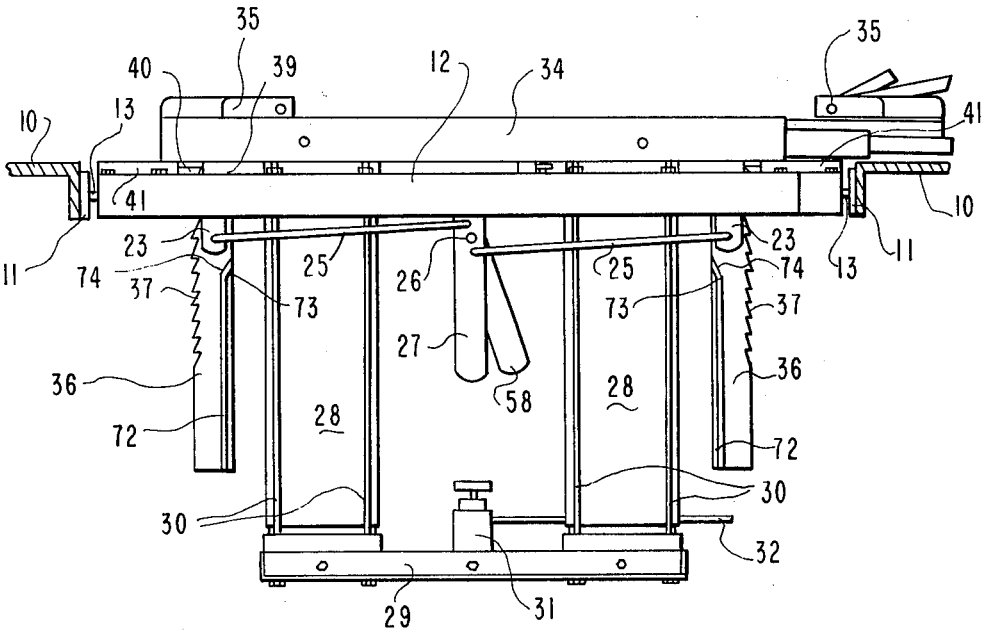
FIG. 1 is a front elevational view of the swing jack assembly showing its several components in a fully lowered position ready to be located beneath a vehicle.

The presently preferred embodiment of the vehicle lifting jack, and particularly the safety means therefore, may be seen in FIGS. 1 and 2, and reference will be made to these views. The vehicle hoist or rack is represented by the runways 10, and the runways are provided with mounting means 11 on the inside or facing flanges for the purpose of supporting the mounting beam 12 which is a U shaped channel member having sufficient length to extend between the runways 10. The mounting beam is a U-shaped member positioned with its opposite flanges turned down, and at its opposite ends there is positioned a pivot pin 13 which is supported in a suitable housing 14 (see FIG. 3) secured within the end portion of the beam 12 between an end closure plate 15 and an inwardly set plate 16. The plates 15 and 16 are directed transversely of the beam 12 and are secured to the depending flanges. It can be appreciated that the mounting beam 12 is able to be pivoted or swung from the vehicle lifting position shown in FIGS. 1 and 2 to the folded position shown in FIG. 6, and the movement between these positions takes place on the axis established by the pivot pins 13.

Figure 6:
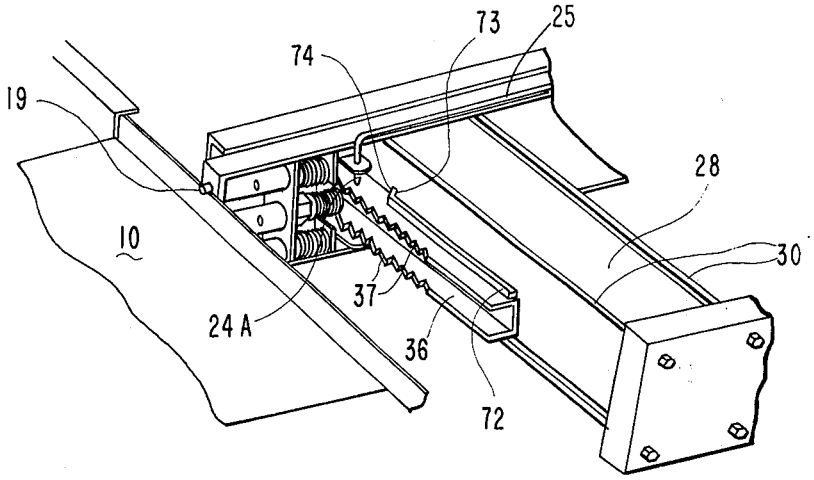
FIG. 6 is a fragmentary perspective view looking into the jack assembly when in its inoperative position to show the detail of a safety cam device.

The inner end of the main pivot pin 13 is encircled by a suitable torsion spring 17, and the spring is tensioned to exert a counterbalancing or unwinding force which tends to lift the entire assembly toward the folded position seen in FIG. 6.

Figure 2:
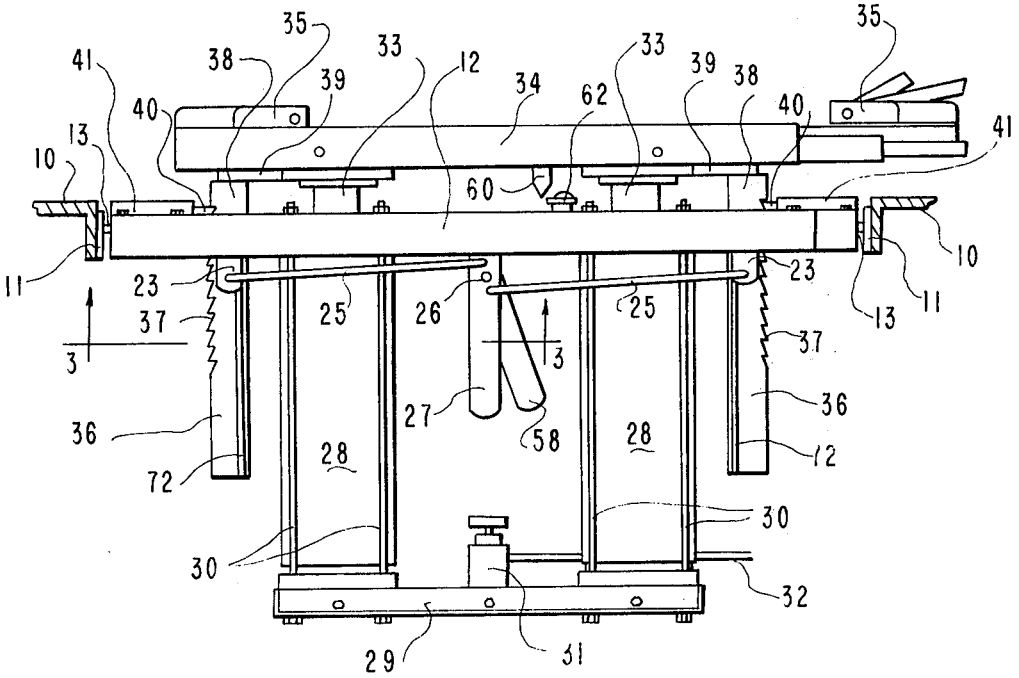
FIG. 2 is a view similar to FIG. 1, but showing the assembly in a partially raised position to illustrate the purpose for certain of the safety means.
Figure 3:
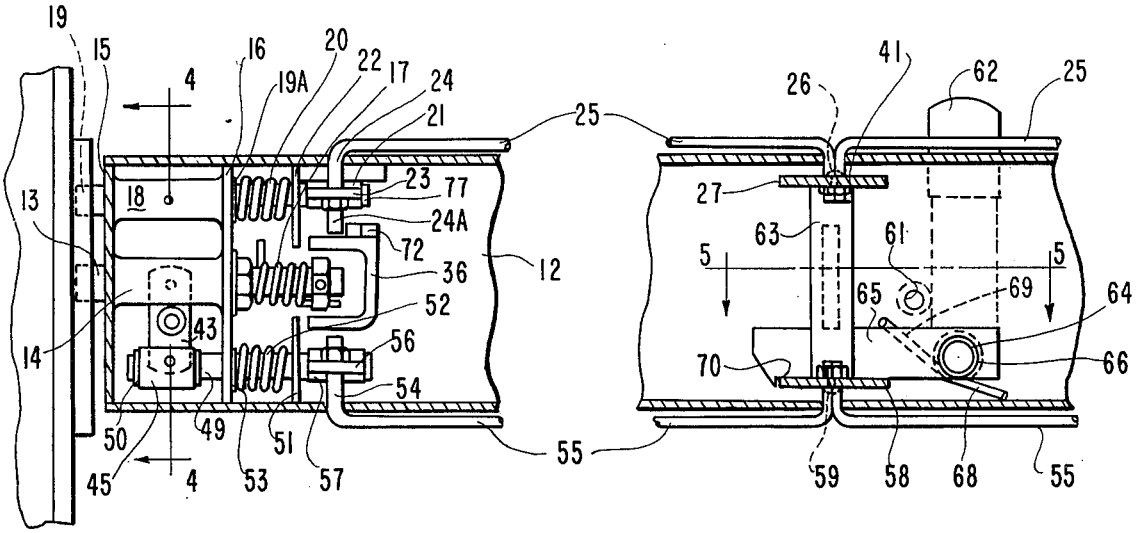
FIG. 3 is a fragmentary view looking up at one end assembly at line 3—3 in FIG. 2, the assembly being typical of the necessary assembly at the opposite end of the swing jack.
Figure 4:
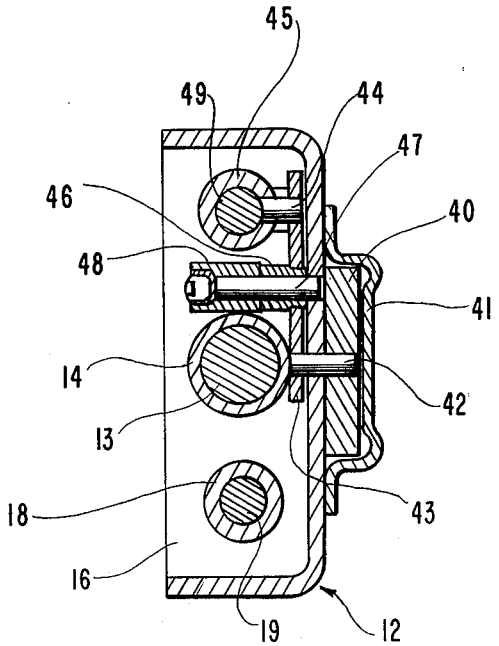
FIG. 4 is a section view taken at line 4—4 in FIG. 3 to show typical means for operating a ratchet dog.

In the views of FIGS. 3 and 4 it can be seen that the end portion of the beam 12 is provided with a housing 18 which is parallel to and spaced from the housing 14, and the housing 18 supports a shiftable lock pin 19. While one end assembly is shown and covered by the following description, it is understood that the opposite end of the beam 12 is provided with a similar assembly. The outer end of the lock pin 19 is suitably located so as to engage in an aperture in the means 11 when in the position of the assembly shown in FIG. 2, or to engage, as shown in FIG. 6, on the upper margin of the means 11. In the latter position of the lock pin 19 the mounting beam 12 will be held in its retracted or folded position of movement around the pivot pins 13. Each of the shiftable lock pins 19 is provided with a suitable spring 20 which forces the lock pins 19 outwardly into locking position with the end of the pin located either in the aperture in the means 11 or engaged on the upper margin of the means 11 as shown in FIG. 6.

In FIGS. 2 and 3, the locking pin 19 is connected to a sleeve 21 on its end portion which projects inwardly through a guide rib 22. The sleeve carries a depending arm 23 which is engaged by the inwardly bent end 24 of a draw link 25. It is seen in FIG. 3 that each drawn link 25 extends inwardly toward the center of the beam 12 and connects on opposite sides of a pivot 26 for an actuating lever 27. If the lever 27 is moved leftwardly (clockwise about pivot 26) the draw links 25 will pull the arm 23 inwardly. The result of that action on the arms 23 is that the lock pins 19 are disengaged from the means 11, thus freeing the beam member 12 for rotation on the pivot pins 13. The torsion spring 17 will, at this time, tend to rotate bar 12 toward its folded position and act to counterbalance the weight of the assembly. It is understood that the pin 19 carries a snap washer 19A just to the right of the plate 16 so that upon rightward movement of pin 19 the spring 20 will be compressed to return the pin to its operative position.

The mounting beam 12 furnishes the principal support for a pair of fluid pressure cylinders 28 in which the lower ends of the cylinders are engaged on a base plate 29, and the base plate is suspended from the mounting beam 12 by tension rods 30. The base plate 29 supports a suitable 3-way valve 31 which is supplied with pressure fluid through conduit 32, and the valve is suitably connected to the cylinders 28 by the usual flexible hose not believed necessary to show. The cylinders are widely spaced so as to exert the lifting effort on the vehicle and render the support of the vehicle in its elevated position sufficiently stable so that adjustment operations on the wheels and the wheels suspension mechanism may be accomplished without fear of disturbing the position of the vehicle.

Each of the cylinders 28 is provided in the usual manner with a piston driven rod or ram 33 which extends upwardly as shown in FIG. 2 for connection with the underside of the vehicle lift bar 34. The lift bar carries at its opposite ends adjustable pads 35 which can be moved inwardly or outwardly so as to be positioned directly beneath a suitable part of the vehicle structure to effect lift of the vehicle off of the hoist runways 10. In the view of FIG. 2 the left hand pad 35 is shown at its innermost setting, while the right hand pad 35 is shown in its extended position.

In the views of FIGS. 1 and 2 it can be seen that the assembly includes a pair of widely spaced ratchet bars 36 which in cross section are U-shaped as shown in FIG. 3. The opposite extended flanges of each ratchet bar 36 are formed with a series of notches 37 which face outwardly toward the adjacent end of the beam 12. The ratchet bars 36 pass through suitable apertures formed in the bar 12 so that the upper ends 38 may be directly connected by suitable pads 39 to the underside of the lift bar 34. As the notches 37 emerge above the upper surface of the beam 12 they are in position to be engaged by pawls 40. Each pawl is retained in position by a cover guide 41 which is secured to the beam 12. As can be best seen in FIGS. 3 and 4 a typical mechanism for actuating the ratchet pawl 40 includes a pin 42 extending from the pawl 40 through a slot in the beam 12 so as to engage in the adjacent end of a pivoted link 43. The opposite end of the link 43 is engaged by a pin 44 on a sleeve 45. The link 43 is carried by a bushing 46 which is pressed into the link, and the bushing is rotatable on a pivot pin 47 having one end press fitted into a suitable aperture in the beam 12 so as to support the link and an adjusting sleeve 48 by which the proper pivoting motion of the link 43 may be obtained. The sleeve 45 is mounted on the adjacent end of a pawl actuating shaft 49 (FIG. 3) and is held fixed to the shaft 49 by suitable retainer rings 50. The shaft 49 passes through the plate 16 and through a guide rib 51 fixed to the beam 12 and spaced from the plate 16 so as to accommodate a compression spring 52 which bears against the guide rib 51 at one of its ends while the opposite end bears against a snap washer 53 carried by the shaft 49. The spring is designed to constantly push the shaft 49 leftwardly as seen in FIG. 3 so as to resiliently retain the link 43 in a position to move the ratchet pawl 40 into or toward the notches 37 in the adjacent ratchet bar 36. The compression spring 52, of course, permits the shaft 49 to move rightwardly under the force of the pawl 40 being pushed in a direction to permit the ratchet bar notches 37 to move upwardly during the elevation of the bar 34. The result is that the pawls move out for each notch and have a snap action to catch the successive ratchet bar notches. As the rams 33 elevate the bar 34 the widely spaced ratchet bars 36 maintain a constant safety catch engagement with the pawls 40 so that if there is failure of the pressure fluid the bar 34 will be retained mechanically in whatever elevated position it has attained.

The pawls 40 can be manually actuated by the bent ends 54 (one being shown) of draw links 55 being engaged in depending arms 56 of sleeves 57, while the inner ends of the links 55 are connected on to a manipulating lever 58 on opposite sides of the pivot 59 for that lever.

The foregoing description has referred to the provision of shiftable locking pins 19 which are spring pressed into a position holding the beam 12 in operative position as illustrated in FIGS. 1 and 2, or in the folded position as illustrated in FIG. 6. The foregoing description has also included a ratchet 36 and pawl 40 mechanism for progressively mechanically catching the vehicle lifting bar 34 as it is raised above the beam 12 by the action of the rams 33 operating in the fluid pressure cylinders 28. The spacing of the ratchet bars on the outside of the respective cylinders 28 provides stability for the bar 34 in its raised position. It is understood that manipulation of the 3-way pressure fluid valve 31 will be effective to supply pressure fluid simultaneously to each cylinder 28 or to release the pressure fluid from the cylinders. Once the bar 34 has been elevated to anyone of several positions in which the pawls 40 engage in the ratchet bar notches 37, manipulation of the valve 31 to release pressure fluid will not disengage the pawls 40.

Figure 5:
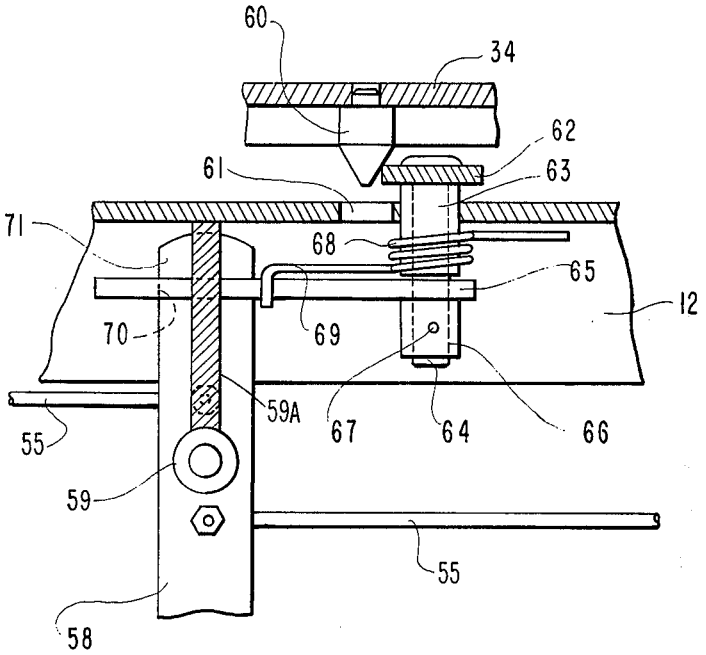
FIG. 5 is a fragmentary sectional view of the ratchet dog reset means, as seen at line 5—5 in FIG. 3.

The safety mechanism associated with the pawls 40 is shown in FIGS. 2, 3 and 5. It is noted in FIGS. 2 and 5 that the bar 34 carries reset pin 60 which is in position to pass through an opening 61 in the beam 12. The reset pin 60 in its movement toward the opening 61 passes the position of a reset lever 62 which is mounted in the beam 12 in a suitable bushing 63. The reset lever 62 is rigidly connected to a pivot shaft 64 which extends below the bushing 63 a sufficient distance to receive a latch 65, and the latch is provided with a fixed sleeve 66 which is fastened to the pivot shaft 64 by a pin 67, thereby fixing the relative positions of the reset lever 62 and the catch 65. A torsion spring 68 is mounted around the bushing 63 and has its operating arm 69 engaged on the catch 65 to exert a force in a direction such that notch 70 in the catch 65 may engage the upper end 71 of the pawl release handle 58. The handle 58 is pivotly mounted on a fixed support 59A fixed to the beam 12.

The manipulation of the lever 58 leftwardly (counterclockwise in FIG. 2) will, through the draw links 25, cause the pivoted link 43 to move the pawls 40 away from engaging in the ratchet notches 37. The lever 58 will have its upper end 71 engage in the notch 7 of catch 65 due to the camming of the catch against spring 68. Once the end 71 has cleared notch 70 the catch 65 will move to capture the lever 58 in the notch 70, thereby holding the pawls 40 retracted. This manipulation is desired when the vehicle lift bar 34 is to be lowered upon release of the pressure fluid at valve 31. Assuming that the vehicle is in elevated position, the operator must move the lever 58 leftwardly to withdraw the pawls 40. Catch 65 will have its notch 70 snap over the end 71 to hold the lever 58 in its moved position. Thereafter, when the bar 34 lowers, the reset pin 60 will engage the reset lever 62 and pivot it out of the way. Motion of lever 62 will cause catch 65 to move such that its notch 70 will release the end 71 of lever 58, and the pawl spring 52 will become active to move the end 71 away from notch 70 in catch 65. This releases the pawls 40 for engaging in the ratchet notches 37 upon the next vehicle lifting cycle.

An important safety feature of the present assembly can be seen in FIGS. 1, 2 and 6 wherein each of the ratchet bars 36 carries an elongated stop bar 72 which extends lengthwise along the surface of the ratchet bars 36 to an upper end 73 which is turned so as to form a cam surface 74. Each of the stop bars 72 is intended to cooperate with the adjacent end 24A of the bent end 24 on draw link 25. The end 24A of each of the draw links 25 has sufficient length (FIG. 6) to be in the path of the cam surface 74 at the end 73 of the stop bar 72. In the retracted position of the vehicle lift bar 34, the cam surface 74 on each stop bar 72 is positioned below the extension 24A on the draw links 25, thereby allowing the draw links (as viewed in FIG. 3) to be moved rightwardly so as to retract the shiftable link pin 19. Upon movement of the sleeve 21 rightwardly, the snap washer 19A engaged on the lock pin 19 adjacent the plate 16 will compress the spring 20 as the lock pin is withdrawn from engagement with the means 11 on the runways 10.

It should now be appreciated that as the pressure fluid elevates the bar 34 under the vehicle, the stop bars 72 will be raised along with the ratchet bars 36 and the cam surfaces 74 thereon will engage the ends 24A of the draw links 25 and pull them into positions forcing the locking pins 19 to be engaged with means 11. Continued upward movement of the ratchet bars 36 will position the stop bars 72 at all times to prevent the withdraw of the locking pins 19. Accidental manipulation of the operating handle 27 for the draw links 25 will be positively prevented, and there will be no danger of releasing the assembly so as to have it pivot around the pins 13 while a vehicle is in a raised position.

During the initial raising of the bar 34 the reset pin 60 will be withdrawn from the opening 61 thereby releasing the reset lever 62 so that the pawl release lever 58 will be ready to have its upper end 71 engaged in the notch 70 of the catch 65, since the catch 65 will be constantly urged by the spring arm 69 toward the upper end 71 of the lever 58. Actual engagement of the lever end 71 in the notch 70 will not take place until the operator deliberately moves the lever 58 sufficiently to withdraw the pawls 40. However, if the valve 31 is set to maintain pressure fluid in the cylinders 28, the vehicle will not lower. Thus, two acts are required to be performed to lower the vehicle; one is to move the lever 58 to withdraw the pawls 40 and the second is to manipulate the valve 31. Not until the vehicle lift bar 34 has descended enough to clear the stop bars 72 from the ends 24A on draw links will it be possible to move the lever 27 to retract the locking pins 19, and by that time the vehicle will again be standing on the runways 10.

In view of the foregoing description of the presently preferred embodiment, it can be appreciated that the vehicle lifting jack assembly is carried by and extends between spaced runways on which the vehicle is supported. There is a vehicle lifting bar operatively carried by a load bearing beam, and a pair of laterally spaced pressure fluid jacks are employed to elevate the lifting bar relative to the beam whereby the vehicle may be lifted off of the runways for appropriate servicing. One of the important features of the assembly resides in the wide spacing of the ratchet bars which are carried upwardly by the lifting bar and are engaged by pawls so as to avoid relying on the pressure fluid, and in this arrangement the ratchet bars are even more widely spaced than the pressure fluid jacks so as to increase the stability of the vehicle in its raised position so that front end alignment service, for example, may be performed with complete reliance on the security of the vehicle in the raised position.

The vehicle lifting jack assembly, in its operative position, required sufficient vertical room to accommodate the pressure fluid cylinders, and this physical arrangement will not generally permit lowering of the runways unless there is a pit into which the cylinders may move. In order to avoid the provision of a pit or other subsurface recess, the load carrying beam of the assembly is arranged to pivot so that the assembly can be folded and occupy a minimum of vertical space. A critical feature with regard to the pivoting freedom of the load carrying beam is means for locking the beam in its operative position so that the vehicle cannot accidentally roll on the runways by reason of the pivoting freedom of the assembly. The locking feature is associated with the ratchet bars so as to accommodate the safety means in conjunction with the means for mechanically holding the lifting bar in whatever raised position is required by using the ratchet and pawl mechanism.

What is claimed is:

1. In a vehicle lifting jack assembly, lift rack runways to carry a vehicle, lifting jack means carried by said runways in position for movement between folded non-lift and operative lift positions to engage a vehicle, power operated means connected to said lifting jack means to effect vehicle lifting movement, safety means responsive to movement of said lifting jack means in lifting a vehicle to prevent accidental reverse movement of said lifting jack means, said safety means including cooperating ratchet and pawl means operable in response to lifting of a vehicle to prevent the accidental reverse movement and means to disable movement of said lift jack means toward folded position, said ratchet means and said pawl means being carried by said lifting jack means, and means carried by said power operated means and connected to said pawl means to disable the latter for lowering the vehicle.

2. The assembly set forth in claim 1 wherein said disabling means is carried by said ratchet means.

3. In a vehicle lifting jack assembly, lift rack runways to carry a vehicle, lifting jack means carried by said runways in position for movement between folded non-lift and operative lift positions to engage a vehicle, locking pin means carried by said lift jack means in position to engage said runways and retain said lift jack means in either of said folded non-lift and operative lift positions, manual means connected to said locking pin means to actuate the latter for changing the position of said lift jack means, power operated means connected to said lifting jack means to effect vehicle lifting movement, safety means responsive to movement of said lifting jack means in lifting a vehicle to prevent accidental reverse movement of said lifting jack means, said safety means including cooperating ratchet and pawl means operable in response to lifting of a vehicle to prevent the accidental reverse movement, said ratchet means and said pawl means being carried by said lifting jack means, and means carried by said power operated means and connected to said pawl means to disable the latter for lowering the vehicle.

4. In a vehicle lifting jack assembly, lift rack runways to carry a vehicle, lifting jack means carried by said runways in position for movement between folded non-lift and operative lift positions to engage a vehicle, retractible locking means on said lift jack means positioned to engage said runways in each position of movement of said lift jack means, manual means connected to said locking means to retract said locking means, power operated means connected to said lifting jack means to effect vehicle lifting movement, safety means responsive to movement of said lifting jack means in lifting a vehicle to prevent accidental reverse movement of said lifting jack means, said safety means including cooperating ratchet and pawl means operable in response to lifting of a vehicle to prevent the accidental reverse movement, said ratchet means and said pawl means being carried by said lifting jack means, and means carried by said power operated means and connected to said pawl means to disable the latter for lowering the vehicle, and means carried by said ratchet means in position to disable said manual means in response to lifting of a vehicle by said lift jack means.

5. A vehicle lift assembly comprising: spaced runways to support the vehicle wheels; a loading carrying member extending between said runways; means pivotally connecting said load carrying member to said runways; a vehicle engaging member; jack means operatively connecting said members to effect movement of said engaging member to engage the vehicle for lifting and lowering the vehicle relative to said runways; said jack means and members being bodily movable about said pivot means between a folded inoperative vehicle lift position and an operative vehicle lift position; lock means between said load carrying member and runways operative to hold said jack means and members in either of said positions; manually operable means connected to said lock means to operate said lock means; and safety means in said assembly in position to disable operation of said manual means in response to movement of said vehicle engaging member toward vehicle engagement whereby said jack means and members are retained in the operative vehicle lift position.

6. A vehicle lift assembly comprising: spaced runways to support the vehicle wheels; a load carrying member extending between said runways; jack means operatively carried by said load carrying member; a lifting bar connected to said jack means and positioned relative to said load carrying member to engage and lift and lower a vehicle relative to said runways; ratchet means comprising a pair of ratchet bars connected to said lifting bar and movable therewith relative to said load carrying member; ratchet engaging pawl means carried by said load carrying member in position to engage said pair of ratchet bars and retain said lifting bar in operative vehicle lift position, said pawl means being operative on said load carrying member to move into and out of engagement with said pair of ratchet bars; control means operatively carried by said load carrying member in position to engage said pawl means and control the action thereof relative to said ratchet means, said control means including a manually movable lever on said load carrying member; links interconnecting said lever and pawl means, said manual lever being movable to a first position to hold said pawl means out of engagement with said pair of ratchet bars and to a second position to release said pawl means; interconnected catch and reset levers, said catch being positioned to engage and hold said manual lever in said first position; reset pin means on said vehicle engaging member in position to engage said reset lever and operate said catch lever to release said manual handle from said first position; and resilient means to operate said manual handle and links whereby said pawl means is urged to engage said pair of bars in response to release of said manual handle by said catch lever.

* * * * *